United States Patent [19]

Wise

[11] Patent Number: 4,848,580

[45] Date of Patent: Jul. 18, 1989

[54] NESTABLE AND STACKABLE CONTAINER FOR BULK MATERIAL

[75] Inventor: Thomas W. Wise, Oreland, Pa.

[73] Assignee: Plastech International, Inc., Warminster, Pa.

[21] Appl. No.: 603,094

[22] Filed: Apr. 23, 1984

[51] Int. Cl.[4] ..... B65D 21/04; B65D 1/46

[52] U.S. Cl. ..... 206/519; 206/508; 206/509; 206/518; 220/72; 220/74

[58] Field of Search ..... 206/508, 509, 511, 518, 206/519; 220/72, 74

[56] References Cited

U.S. PATENT DOCUMENTS

| | | | |
|---|---|---|---|
| 2,814,427 | 11/1957 | Emery | 206/519 |
| 3,307,739 | 3/1967 | Cloyd | 220/72 |
| 3,434,625 | 3/1969 | Embry | 206/518 |
| 4,042,111 | 8/1977 | Smith | 206/508 |

FOREIGN PATENT DOCUMENTS

| | | | |
|---|---|---|---|
| 2411777 | 8/1979 | France | 206/511 |
| 369401 | 6/1963 | Switzerland | 206/518 |

*Primary Examiner*—George E. Lowrance

*Attorney, Agent, or Firm*—John F. A. Earley; John F. A. Earley, III; P. Michael Walker

[57] ABSTRACT

A container for handling and storing large quantities of bulk material such as food products, comprises a unitary molded plastic liquid-tight single wall tank or tub having a bottom and four upwardly extending walls, corner nesting stops located at each corner at the upper end of the container, a lip along the upper edges of the walls, and gussets at the top of the walls supporting the lip. A lid fits over the container lip and has a skirt that is blended inwardly toward the lip so as not to catch on a lip or lid of an adjacent container.

7 Claims, 1 Drawing Sheet

NESTABLE AND STACKABLE CONTAINER FOR BULK MATERIAL

BACKGROUND OF THE INVENTION

1. Field of the Invention

This invention relates to stackable containers for bulk materials, and more specifically concerns large containers for food and chemicals, for example, for shipping processed chickens from one processor to another for further processing.

2. Description of the Prior Art

In certain industries such as in food processing, agriculture, chemical, and petro-chemical industries, large containers are used to hold and ship bulk materials. The handling and lifting of these containers require the use of forklift trucks and/or pallet jacks.

In recent years, containers made entirely of plastic have been used, such as those described in U.S. Pats. Nos. 4,042,111 and 4,416,374 which are incorporated herein by reference. These containers are closed by placing a lid or cover over the lip of the container.

A problem with these containers has been that the edges of the lids and the lips of the tanks can be broken by forces stricking the overhanging portion of the lid and lips.

For example, in the food industry, 42½ inch wide containers containing bulk materials such as chicken parts are loaded side by side in trucks having inside walls 90 inches apart. If a forklift driver is careless or sloppy when placing a first container in the truck so that it is not flush against the side wall of the truck, when he drops a second container next to the first, the second container may strike an overhanging portion of the lid or lip of the first and break it.

SUMMARY OF THE INVENTION

Objects of the present invention are to provide a single wall nestable tank capable of being stacked on the lid of another tank below, and to provide the tank with a stronger lip to prevent chipping and breakage of the tank upper edges and any potential for damage. A tight fitting cover for the tank overlies the tank vertical peripheral lip so that the cover skirt does not project outwardly unduly and is blended toward the vertical lip of the tank so as not to catch on the lip or lid of an adjacent container during loading of containers into a truck, for example.

Another object is to provide a single wall nestable tank molded of plastic in seamless one-piece construction with gussets that reinforce the vertical peripheral lip of the tank, so that the gusset acts like a shelf bracket to support the outside portion of the lip.

DETAILED DESCRIPTION

Figure 1:
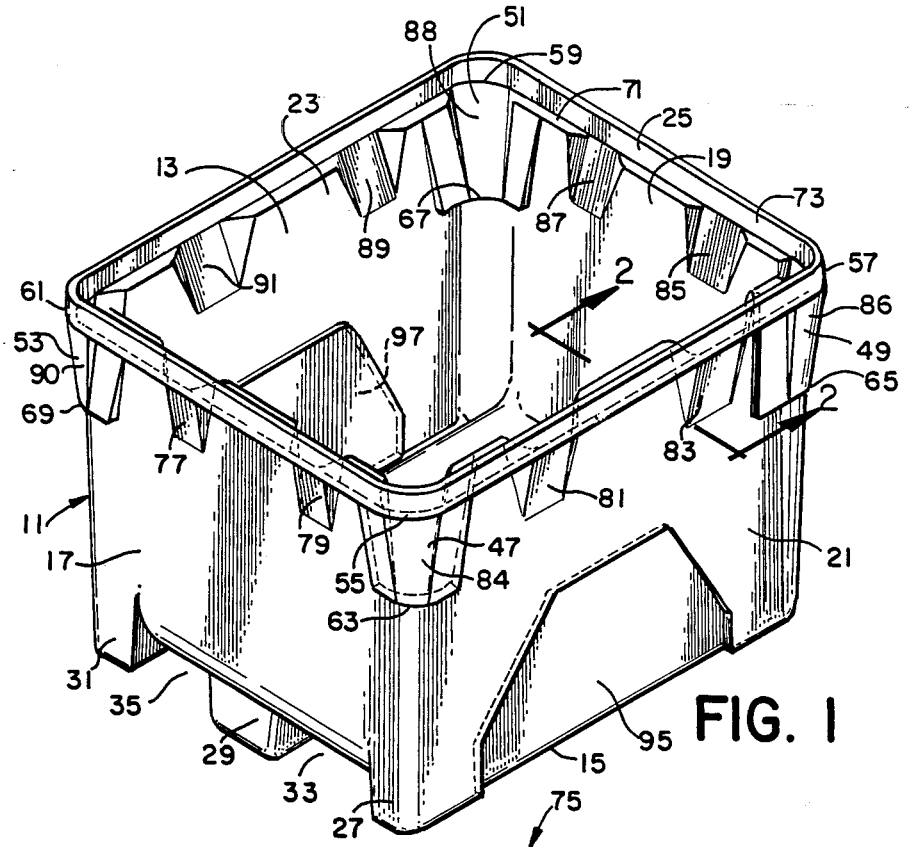
FIG. 1 is a perspective view of a tank constructed in accordance with this invention.

Turning now to the drawings, there is shown a container 11 for handling and storing large quantities of bulk material such as food products, which comprises a unitary molded plastic liquid-tight single walled tank or tub 13 having a bottom 15, four upwardly extending side walls 17, 19, 21 and 23, and a lip 25 along the upper edges of the four side walls 17, 19, 21 and 23.

In the bottom 15 of the container 11, there are formed three parallel, laterally spaced, downwardly extending hollow ridges 27, 29, and 31, that act as supporting members for the container 11. These ridges 27, 29 and 31 are integrally molded into bottom 15. The bottoms of these ridges 27, 29 and 31 are coplanar so that all three can rest simultaneously on a flat floor to support the container 11.

Ridges 27, 29 and 31 extend substantially the full length of the bottom 15 of the tank 13, and establish, between adjacent pairs of ridges 27 and 29, 29 and 31, spaces 33 and 35 for entry of tines of a forklift or pallet jack.

The four side walls 17, 19, 21 and 23 are typically one-quarter inch in thickness, and slope slightly outwardly from bottom to top by a distance greater than the thickness of the walls to facilitate nesting and unnesting when containers 11 are not in use.

In order to prevent the containers 11 from wedging together when nesting one inside another, tank 13 is provided with corner nesting stops 47, 49, 51 and 53 at each corner 55, 57, 59 and 61 at the upper end of container 11. The corner nesting stops 47, 49, 51 and 53 preferably extend downwardly 11 inches from the top of container 11 and slope outwardly from bottom to top. The bottom edges 63, 65, 67 and 69 of the corner nesting stops preferably extend outwardly from the four walls 17, 19, 21 and 23 by typically three-quarters of an inch.

A lip 25 extends along the upper edges of the walls 17, 19, 21 and 23 and comprises a ledge 71 and a lip wall 73. The lip is adapted so that a cover or lid 75 may be supported by lip wall 73 which it surrounds. Lid 75 is a tight fitting cover for the tank 13 and its skirt 76 overlies the tank vertical lip wall 73 so that the cover skirt 76 does not project outwardly unduly. Skirt 76 is provided with a portion 78 that is blended inwardly toward the vertical lip wall 73 of the tank 13 so as not to catch on a lip or lid of an adjacent container. Lip wall 73 is preferably 1¼ inches high. In the preferred embodiment, there is an angle of 100 degrees between ledge 71 and lip wall 73.

Molded into the walls 17, 19, 21 and 23 are gussets 77, 79, 81, 83, 85, 87, 89 and 91, and corner gussets 84, 86, 88 and 90, that act as support means for the lip 25. Each gusset provides support to the lip 25 by reinforcing the ledge 71 which extends around the periphery of the tank 13 and is flush with the outside periphery of the lip wall 73. Each gusset also acts as a guide for a tank being lowered next to an adjacent tank to guide or cam the tanks into proper position.

In addition to acting as lip 25 supports and guides, the corner gussets 84, 86, 88 and 90 preform a third function. The corner gussets 84, 86, 88 and 90 act as bumpers to protect the tank corners from damage due to impacts with door jambs when being transported on a forklift truck, for example.

The tank 13 may be molded with recess 95 and recess 97 in opposing side walls to reinforce the lower inner walls of the tank against deflection.

Figure 3:
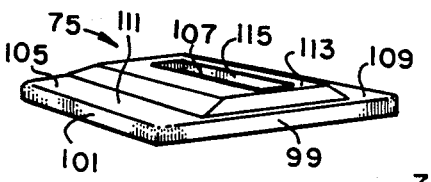
FIG. 3 is a perspective view of a lid for the tank shown in FIG. 1.
Figure 2:
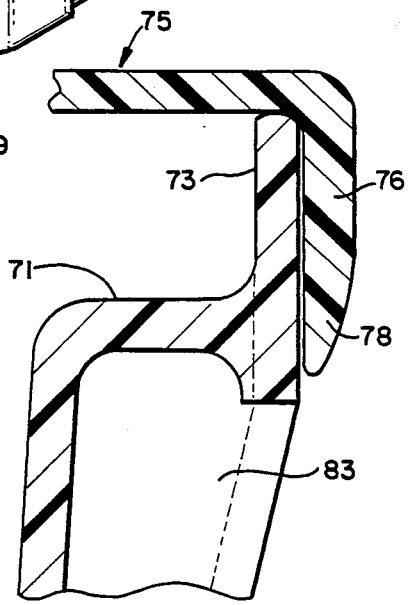
FIG. 2 is a partial view in section of a container showing the lip of the tank and a lid closing the tank taken as indicated by lines and arrows 2—2 in FIG. 1.

Referring now to FIG. 3, the cover 75 is a unitary piece of molded plastic adapted to rest on lip 25. Preferably, cover 75 is provided with four downwardly extending sides, including sides 99 and 101, to form a skirt 76 adapted to fit tightly over lip 25 to provide a secure closure, and prevent the cover from moving laterally with respect to the tank 13.

Three elongated, parallel, substantially coplanar surfaces 105, 107 and 109 are provided on the upper side 111 of the lid 75. These surfaces are adapted to support the parallel, laterally spaced, downwardly extending hollow ridges of another container resting thereon so that similar containers, either empty or filled, can be stacked one upon the other. Coplanar surface 107 is surround by a ridge 113 that is integrally molded into the lid 75. Ridge 113 has an inner wall 115 that conforms to the shape of hollow ridge 29 of the tank 13 to secure a container resting on surfaces 105, 107 and 109 against lateral motion and rotation. The ridge 113 preferably surrounds the center coplanar surface 107 on the upper side 111 of the lid 75; however, the ridge 113 could be positioned around any one of the three coplanar surfaces 105, 107 and 109, or a combination thereof. The height of ridge 113 is preferably as short as possible in order not to interfere with the tines of a forklift or a pallet jack used to stack containers.

I claim:

1. A plastic container for handling and storing large quantities of bulk material such as food products, comprising a molded plastic tank having a bottom, four upwardly extending side walls, a lip along the upper edges of the four upwardly extending side walls, said side walls including nesting stop means for facilitating nesting and unnesting of the container in a similar container by limiting the distance an upper nesting container extends into a lower nesting container, said nesting stop means including sloping gusset means sloping outwardly from the stop to the lip, and said side walls further including lip support sloping gusset means, sloping outwardly from the side walls to the lip for supporting the lip at the top of the four side walls.

2. The container of claim 1, also comprising a lid means adapted to fit onto the lip of the tank for covering it.

3. The container of claim 1, said lip comprising a lip ledge at the top of the side walls and a lip wall extending upwardly from the outer portion of the lip ledge.

4. The container of claim 1, said bottom including three parallel, laterally spaced, downwardly extending, hollow ridges forming supporting members for the container being integrally molded in said bottom, said ridges extending substantially the full length of the bottom of the tank, and establishing between adjacent pairs of ridges, spaces for entry of tines of a forklift or pallet jack.

5. The container of claim 1, said nesting means being nesting stops located in each corner of the upper end of the container.

6. The container of claim 1, including corner gusset means for guiding a tank into position adjacent another tank, for supporting said lip, and for acting as bumpers to protect the tank corners from damage.

7. A plastic container for handling and storing large quantities of bulk material such as food products, comprising a molded plastic tank having a bottom, four upwardly extending side walls, a lip along the upper edges of the four upwardly extending side walls, said side walls including nesting stop means for facilitating nesting and unnesting of the container in a similar container by limiting the distance an upper nesting container extends into a lower nesting container, said nesting stop means including sloping corner gusset means sloping outwardly from the stop to the lip, and said side walls further including lip support sloping gusset means sloping outwardly from the side walls to the lip for supporting the lip at the top of the four side walls, said lid support means for supporting the lip being gussets sloping outwardly from the side walls of the container to the outer portion of the lip, and lid means adapted to fit onto the lip of the tank for covering it, said lip comprising a lip ledge at the top of the side walls and a lip wall extending upwardly from the outer portion of the lip ledge, said bottom including three parallel, laterally spaced, downwardly extending, hollow ridges forming supporting members for the container being integrally molded in said bottom, said ridges extending substantially the full length of the bottom of the tank, and establishing between adjacent pairs of ridges, spaces for entry of tines of a forklift or pallet jack, said nesting stop means being nesting stops located in each corner of the upper end of the container, said corner gusset means being adapted for guiding a tank into position adjacent another tank, for supporting said lip, and for acting as bumpers to protect the tank corners from damage.

* * * * *